US009776031B2

(12) United States Patent
Ho et al.

(10) Patent No.: US 9,776,031 B2
(45) Date of Patent: Oct. 3, 2017

(54) TORSION BASED EXERCISER

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 0 days.

(21) Appl. No.: 14/936,617

(22) Filed: Nov. 9, 2015

(65) Prior Publication Data

US 2017/0007874 A1 Jan. 12, 2017

Related U.S. Application Data

(63) Continuation-in-part of application No. 14/801,731, filed on Jul. 16, 2015, which is a continuation-in-part of application No. 14/793,680, filed on Jul. 7, 2015.

(51) Int. Cl.
*A63B 21/00* (2006.01)
*A63B 21/02* (2006.01)
(Continued)

(52) U.S. Cl.
CPC ..... *A63B 21/0455* (2013.01); *A63B 21/028* (2013.01); *A63B 21/04* (2013.01);
(Continued)

(58) Field of Classification Search
CPC ..... A63B 21/00058; A63B 21/00069; A63B 21/00072; A63B 21/00178; A63B 21/00181; A63B 21/00185; A63B 21/00189; A63B 21/002; A63B 21/0023; A63B 21/02; A63B 21/021; A63B 21/022; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055;
(Continued)

(56) References Cited

U.S. PATENT DOCUMENTS 2,374,730 A * 5/1945 De Forest ..... A63B 22/0056 482/80
3,371,927 A * 3/1968 Ryan ..... A63B 25/08 267/153
(Continued)

*Primary Examiner* — Loan H Thanh
*Assistant Examiner* — Gary D Urbiel Goldner
(74) *Attorney, Agent, or Firm* — Blakely, Sokoloff, Taylor & Zafman LLP

(57) ABSTRACT

An exercise machine including a support frame having a handle structure affixed to a base structure is described. The handle structure can provide hand support for a user using the machine. The base structure can provide floor support for the machine. One or more resilient pedaling assemblies may be pivotably coupled with the base structure to guide exercising movements of the user. Each resilient pedaling assembly may comprise an elastic element to provide a torsion force, a foot pad for resting a corresponding foot of the user and pivot assemblies rotatably engaged with the elastic element and the foot pad. Movement of the foot pad may cause deformation of the elastic element via the pivot assemblies. The deformation can induce the torsion force from the elastic element to provide reciprocal foot pedaling effects to the user.

20 Claims, 8 Drawing Sheets

(51) Int. Cl.

| | |
|---|---|
| ***A63B 21/04*** | (2006.01) |
| ***A63B 21/045*** | (2006.01) |
| ***A63B 22/20*** | (2006.01) |
| ***A63B 23/02*** | (2006.01) |
| ***A63B 23/08*** | (2006.01) |
| ***A63B 23/10*** | (2006.01) |
| ***A63B 23/12*** | (2006.01) |

(52) U.S. Cl.
CPC ..... *A63B 21/4007* (2015.10); *A63B 22/20* (2013.01); *A63B 23/0211* (2013.01); *A63B 23/085* (2013.01); *A63B 23/10* (2013.01); *A63B 23/12* (2013.01); *A63B 2225/093* (2013.01)

(58) Field of Classification Search
CPC ..... A63B 21/0552; A63B 21/0555; A63B 21/0557; A63B 21/0607; A63B 21/068; A63B 21/15; A63B 21/159; A63B 21/22; A63B 21/4033; A63B 21/4034; A63B 21/4045; A63B 21/4047; A63B 21/4049; A63B 22/0048; A63B 22/0056; A63B 22/0058; A63B 22/0066; A63B 22/0069; A63B 22/04; A63B 22/14; A63B 22/16; A63B 22/18; A63B 22/20; A63B 22/201; A63B 22/205; A63B 22/208; A63B 2022/0071; A63B 2022/0074; A63B 22/206; A63B 23/0222; A63B 23/035; A63B 23/03516; A63B 23/03533; A63B 23/04; A63B 23/0405; A63B 23/0429; A63B 23/0482; A63B 23/0494; A63B 2023/0447; A63B 26/00; A63B 26/003; A63B 71/0054; A63B 2071/0063; A63B 2071/0072; A63B 2071/0081; A63B 2071/009; A63B 2208/0204; A63B 2208/0209
See application file for complete search history.

(56) References Cited

U.S. PATENT DOCUMENTS 3,441,271 A * 4/1969 Palacios ..... A63B 22/14 472/14
3,511,500 A * 5/1970 Dunn ..... A63B 21/015 482/113
3,741,540 A * 6/1973 Shimizu ..... A63B 23/085 482/128
3,929,329 A * 12/1975 Rivera ..... A63B 21/05 482/146
4,101,136 A * 7/1978 Corll ..... A63B 69/18 482/146
4,285,516 A * 8/1981 Heatwole ..... A63B 21/0004 482/146
4,376,532 A * 3/1983 Hunstad ..... A63B 69/18 482/146
4,530,498 A * 7/1985 Heatwole ..... A63B 21/0004 482/146
4,700,947 A * 10/1987 Heatwole ..... A63B 21/0004 482/146
4,739,986 A * 4/1988 Kucharik ..... A63B 23/08 482/146
4,987,679 A * 1/1991 Rau ..... F16F 1/52 156/313
5,298,002 A * 3/1994 Lin ..... A63B 22/0058 482/53
5,391,134 A * 2/1995 Heatwole ..... A63B 26/003 482/123
5,460,565 A * 10/1995 Perneczky ..... B21B 28/04 451/162
6,306,068 B1 * 10/2001 Heatwole ..... A63B 21/0004 482/146
6,382,572 B1 * 5/2002 Lin ..... A63B 55/53 206/315.7
7,771,327 B1 * 8/2010 Reams ..... A63B 21/0552 482/123
7,862,481 B2 * 1/2011 Chen ..... A63B 22/0069 482/52
9,440,105 B1 * 9/2016 Lee ..... A63B 23/04
2004/0192514 A1 * 9/2004 Piaget ..... A63B 22/0292 482/54
2004/0214693 A1 * 10/2004 Piaget ..... A63B 22/0056 482/52
2005/0113215 A1 * 5/2005 Chuang ..... A63B 22/001 482/52
2006/0270526 A1 * 11/2006 Jyr ..... A63B 22/0056 482/53
2008/0061614 A1 * 3/2008 Masunaga ..... A47C 1/03255 297/285
2009/0270229 A1 * 10/2009 Chen ..... A63B 22/0012 482/52
2009/0280962 A1 * 11/2009 Chen ..... A63B 22/0012 482/52
2009/0291808 A1 * 11/2009 Chen ..... A63B 23/0429 482/52
2009/0291809 A1 * 11/2009 Chen ..... A63B 21/0552 482/52
2010/0248923 A1 * 9/2010 Lo ..... A63B 5/00 482/146
2011/0111927 A1 * 5/2011 Kim ..... A63B 21/00192 482/52
2014/0274585 A1 * 9/2014 Huang ..... A63B 23/10 482/79
2015/0238798 A1 * 8/2015 Liu ..... A63B 22/16 482/127
2016/0059070 A1 * 3/2016 Tung ..... A63B 21/0552 482/112
2016/0213971 A1 * 7/2016 Jones ..... A63B 22/0061

* cited by examiner

TORSION BASED EXERCISER

RELATED APPLICATIONS

This application is a continuation-in-part (CIP) of U.S. patent application Ser. No. 14/801,731, filed on Jul. 16, 2015, which is a CIP of U.S. patent application Ser. No. 14/793,680, filed on Jul. 7, 2015. The disclosure of the above applications hereby incorporated by reference herein in its entirety.

FIELD OF INVENTION

The present invention relates generally to an exercising machine, and in particular, to a muscle-developing exerciser for training the muscles of the lower body.

BACKGROUND

With the growing awareness of health problems caused by lack of exercise, the popularity of exercise machines has steadily increased. These machines may be designed with resilient components to provide counter forces against movements exerted by users for exercise purposes. There are chest developing machines provided with resilient components based on spring elements. However, these machines may be limited by the spring elements which are not only complicated in structure, but costly to construct, hard to maintain, and heavy in weight. Therefore, there is a need to provide better chest developing machines.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further, specific numeric references such as first, second, third, etc., may be made. However, the specific numeric references should not be interpreted as a literal sequential order but rather interpreted as references to different objects. Thus, the specific details set forth herein are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

According to some embodiments, an exercise machine can include a support frame having a handle structure affixed to a base structure. The handle structure can provide support for dexterity while using the machine. The base structure can provide floor support for the machine. One or more resilient pedaling assemblies may be coupled pivotably with the base structure to guide the exercising movements of the user. The resilient pedaling assemblies may provide counter balance force to enhance exercise effects.

Each resilient pedaling assembly may comprise an elastic element to provide torsion force, a foot pad for foot resting and pivot assemblies rotatably engaged with the elastic element and the foot pad. Movement of the foot pad may cause deformation of the elastic element via the resilient pedaling assemblies. The deformation can induce the torsion force from the elastic element to provide reciprocal foot pedaling effects to the user.

Other advantages and features of the present invention will become manifest to those versed in the art upon making reference to the detailed description and the accompanying sheets of drawings in which a preferred structural embodiment incorporating the principles of the present invention is shown by way of illustrative example.

Figure 1:
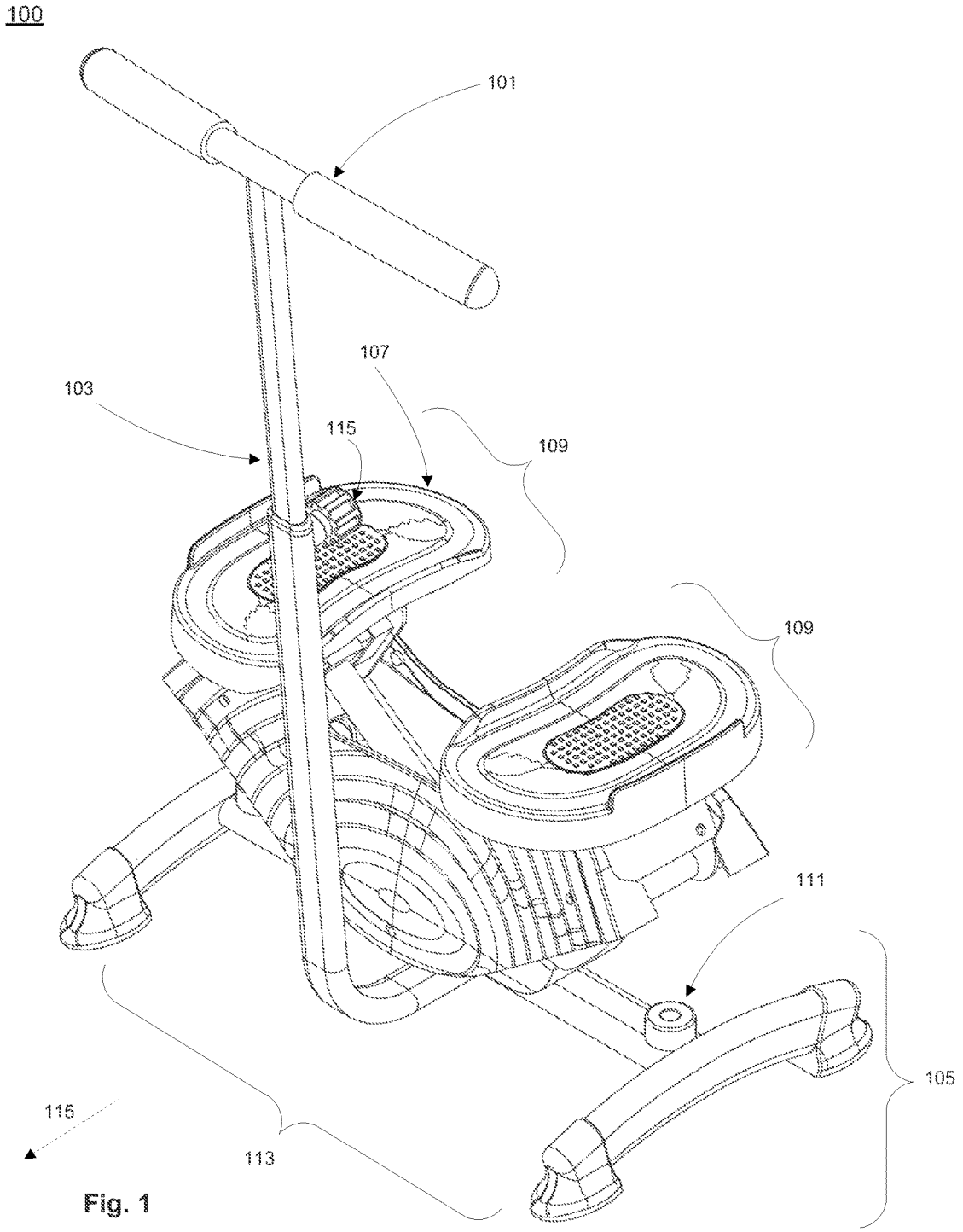
FIG. 1 is a perspective diagram illustrating an embodiment of a torsion based exerciser.

FIG. 1 is a perspective diagram illustrating an embodiment of a torsion based exerciser (or machine). Device 100 may include support frame 113 pivotably coupled with resilient pedaling assemblies 109 which is capable of providing counter resistance force when moved from a rest position. Support frame 113 may include base structure 105 to provide floor support and a handle structure to provide hand support for a user of device 100. The handle structure can include handle stand 103 and handlebar 101. The lower end of handle stand 103 may be fixedly attached to base structure 105. Handle bar 101 may be defined at the upper end of handle stand 103. The height (e.g. between lower end and upper end) of handle stand 103 may be adjustable via knob 115.

Resilient pedaling assemblies 109 may be pivotably coupled to a top portion of base structure 105 laterally between two sides of handle stand 103 or the support frame. Resilient pedaling assembly 109 may pivot around a pedaling axis substantially parallel to (or aligned with) front direction 115 of device 100 (e.g. along handle stand 103 and base structure 105). Foot pad 107 may be rotatably affixed with resilient pedaling assembly 109 to allow a user to apply pedaling force. Foot pad 107 may rotate around an axis substantially transverse to the pedaling axis of resilient pedaling assembly 109.

In one embodiment, device 100 may include a pair of left resilient pedaling assembly and right resilient pedaling assembly 109 paired with a set of foot pads 107. The pair of resilient pedaling assembly 109 may pivot together (e.g. mutually coupled or engaged between each other) in a rocking manner between the two sides of handle stand 103 substantially transverse to the front direction 115. Pedal stop 111 may be defined on base structure 105 to limit the extent of pivoting (or rotating) on the pair of resilient pedaling assembly 109.

Each resilient pedaling assembly 109 may comprise an elastic element (not shown) to provide torsion force to counter rotation movements of resilient pedaling assembly 109. The torsion force may be induced via deformation of the elastic element without requiring extra space to accommodate changes in the physical shape of the elastic element when deformed. For example, the elastic element may be deformed in a twisted manner along its longitudinal direction substantially parallel to the pedaling axis of resilient pedaling assemblies 109. The elastic element may be arranged to ride along with foot pad 107 as resilient pedaling assembly 109 rotates or pivots.

Figure 2:
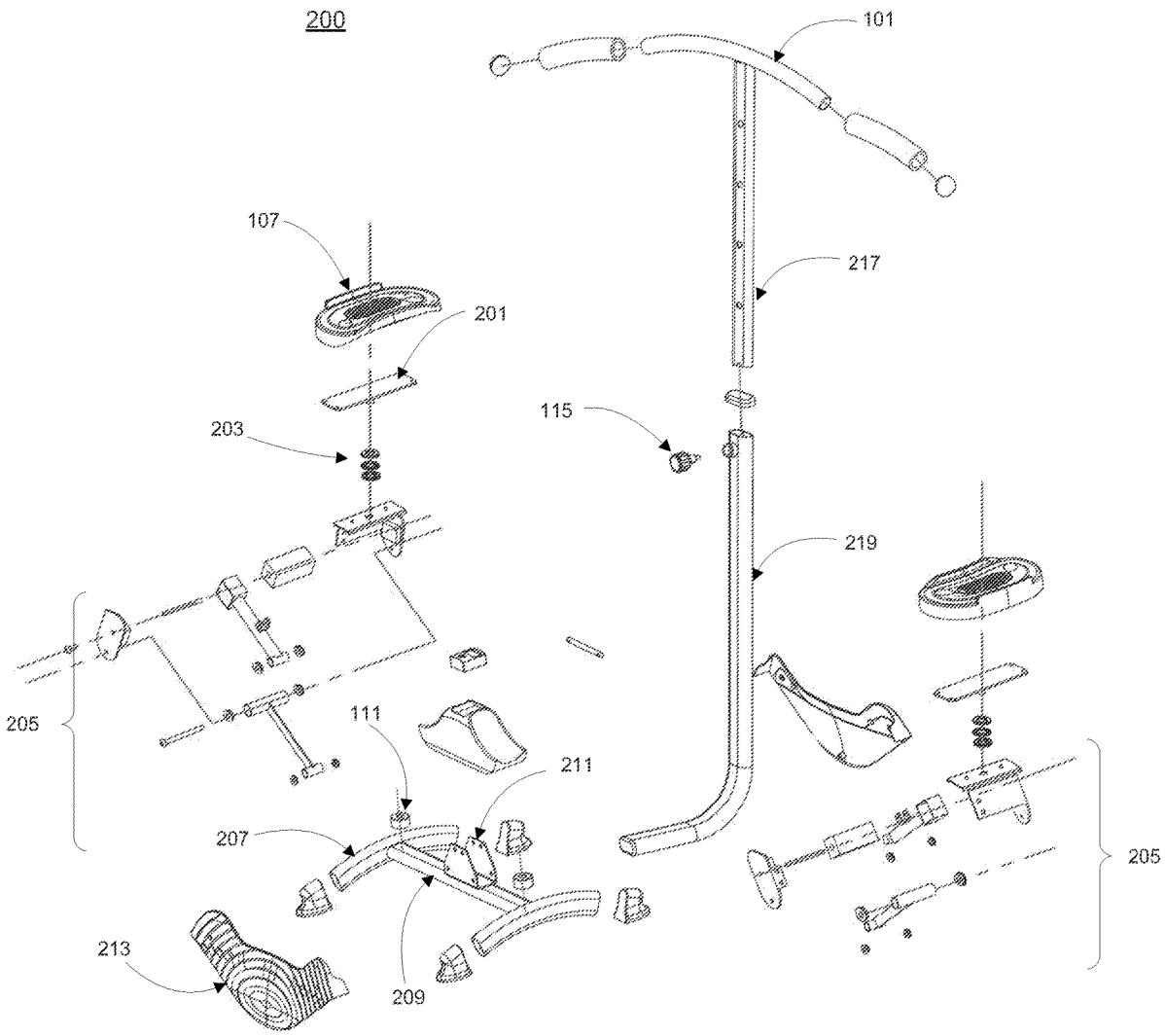
FIG. 2 is a component diagram illustrating an embodiment of a torsion based exerciser.

FIG. 2 is a component diagram illustrating an embodiment of a torsion based exerciser. For example, view 200 may be based on device 100 of FIG. 1. In one embodiment, handle stand 103 may be retractably configured with multiple sections including upper section 217 and lower section 219. Handle stand 103 may be lengthened or shortened via knob 115 selectively inserted to one of multiple coupling positions defined along upper section 217.

Resilient pedaling assembly may include torsion resilient mechanism 205 configured to provide resilient counter force against movements caused by user stepping on foot pad 107. In one embodiment, foot pad 107 may be affixed to pedal bracket 201 pivotably coupled with torsion resilient mechanism 205 (e.g. via screws, bolts, circular springs, or other applicable rotatable coupling components).

Base structure 105 may include at least one leg member 207 defined, for example, on each of two sides of handle stand 103. Cross support member 209 may be affixed between leg members 207 longitudinally along a lateral direction relative to front direction 115 of FIG. 1. Mounting element 211 may be fixedly attached over cross support member 211. Resilient pedaling assembly 109 may be rotatably coupled with base structure 105 via mounting element 211.

Figure 3:
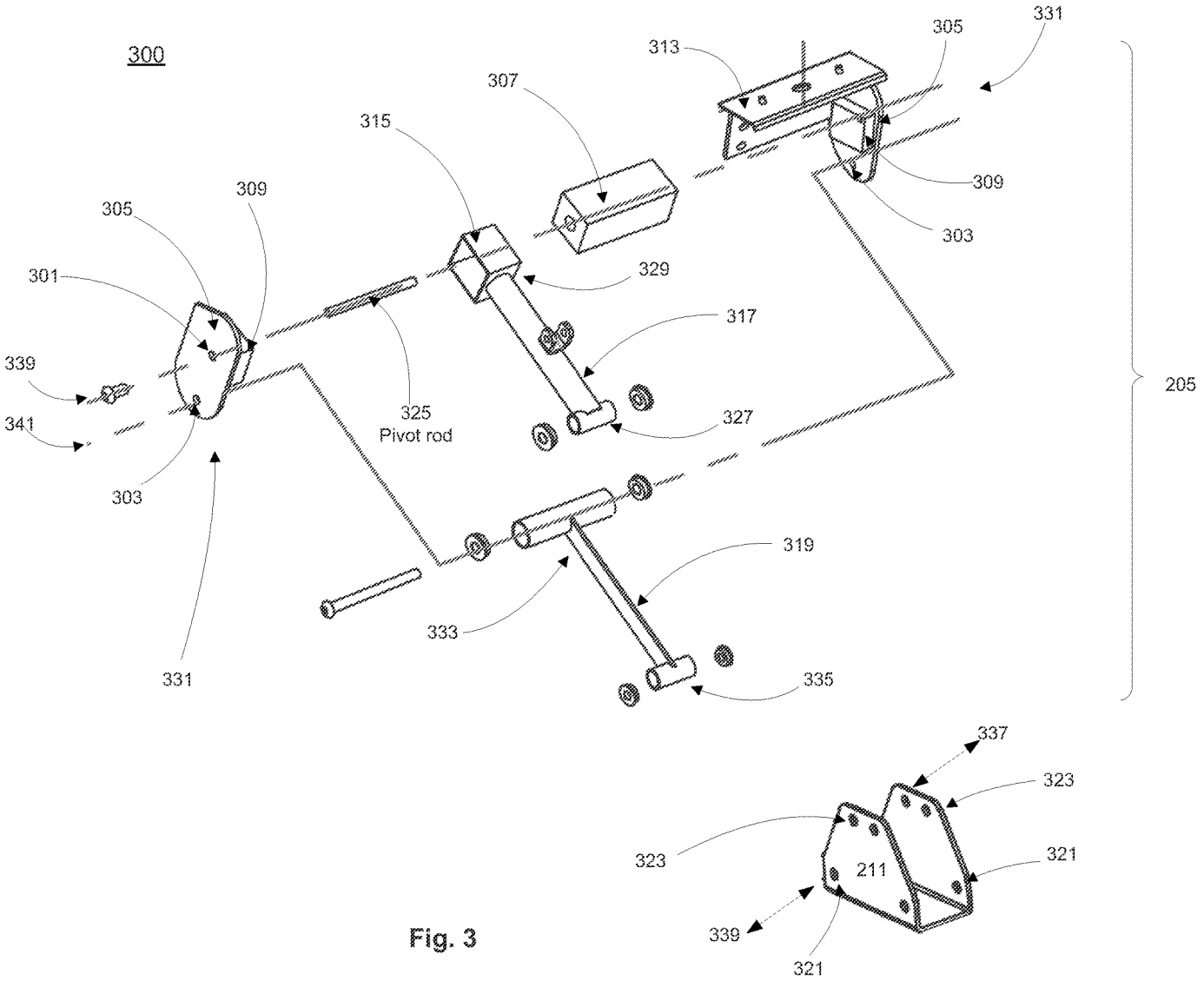
FIG. 3 is a component diagram illustrating an embodiment of a resilient assembly based on a torsion device.

FIG. 3 is a component diagram illustrating an embodiment of a resilient assembly based on a torsion device. For example, view 300 may be based on device 100 of FIG. 1. In one embodiment, torsion resilient mechanism 205 can include pivot assemblies and elastic element 307 to provide torsion force. Pivot assemblies may be rotatably coupled with foot pad 107 and elastic element 307 via substantially transverse axes of rotations. Elastic element 307 may have a longitudinal direction between two ends. Foot pad 107 may be rotatably coupled with the pivot assemblies via an axis of rotation substantially transverse to the longitudinal direction of elastic element 307.

In one embodiment, pivot assemblies may comprise an end pivot assembly and a middle pivot assembly. The end pivot assembly may be rotatably engaged with both ends of elastic element 307. The middle pivot assembly may be rotatably engaged with a portion of elastic element 307 between the two ends. Foot pad 107 may be movably coupled to the end pivot assembly. Movement of foot pad 107 may cause deformation of elastic element 307 via the end pivot assembly and the middle pivot assembly. The deformation can induce the torsion force from elastic element 307 to provide reciprocal foot pedaling effects to a user exercising force on foot pad 107.

The middle pivot assembly may comprise torsion arm 317 longitudinally having distal end 329 and proximal end 327 arranged substantially transverse to the longitudinal direction of elastic element 307. In one embodiment, sleeve element 315 may be affixed to torsion arm 317 at distal end 329 to engage with elastic element 307. A portion of elastic element 307 may be fittingly confined within or through sleeve element 315. Movement of the portion of elastic element 307 around the longitudinal direction of elastic element 307 may be restricted by sleeve element 315, for example via angularly shaped housing, resistive contact surfaces or other applicable engagement mechanism.

According to one embodiment, the end pivot assembly can include gripper structures 331 fittingly arranged to hold two longitudinal ends of elastic element 307. For example, separate gripper structure 331 may be defined at each end of elastic element 307. Gripper structure 331 may be pivotable around torsion axis 339 defined substantially aligned with the longitudinal direction of elastic element 307. Distal lever axis 341 may be defined by gripper structures 331 as substantially parallel to torsion axis 339 of elastic element 307. The end pivot assembly may include lever arm 319 having proximal end 333 and distal end 335. Lever arm 319 may be pivotally coupled with gripper structures 331 via distal end 335 of lever arm 319.

In one embodiment, gripper structure 331 can comprise one or more side plates 305, each having cap configuration 309 to accommodate one longitudinal end of elastic element 307. Gripper structures 331 and lever arm 319 may be pivotally coupled via distal end 333 of lever arm 319. For example, lever arm 319 may be rotatable around distal lever axis 341 relative to gripper structures 331.

Gripper structure 331 may include coupling plate 313 affixed between side plates 305. In some embodiments, foot pad 107 may be rotatably coupled with coupling plate 305. For example, foot pad 107 may be rotatable around a rotation axis substantially transverse to the longitudinal direction of elastic element 307 over a plane, for example, substantially parallel to a ground floor supporting base structure 105 of FIG. 1.

In one embodiment, mounting element 211 of base structure 105 of FIG. 1 can define multiple axes, for example, including proximal arm axis 337 and proximal lever axis 339. Torsion arm 317 may be rotatably coupled with mounting element 211 via proximal end 327 of torsion arm 317. For example, torsion arm 317 may be rotatable around proximal arm axis 337 of mounting element 211. Lever arm 319 may be pivotally coupled with mounting element 211 via proximal end 333 of lever arm 319 to allow lever arm 319 to rotate around proximal lever axis 339 of mounting element 211. In one embodiment, proximal arm axis 337, proximal lever axis 339 and the torsion axis of elastic element 307 may be arranged substantially parallel to each other to ensure pivoting movements of resilient pedaling assemblies 109.

According to one embodiment, simultaneous pivoting of lever arm 319 and torsion arm 317 can allow or constrain foot pad 107 coupled to coupling plate 313 to move up and down in a rocking manner. For example, the movement of foot pad 107 may be confined by a combination of lever arm 319 pivoting around proximal lever axis at proximal end 335, gripper structures 331 pivoting around distal lever axis 341 and torsion arm 317 pivoting around proximal arm axis 337 at proximal end 335. Pivoting around both torsion arm 317 and lever arm 319 may allow gripper structures 331 to maintain a flat position (e.g. relative to the floor with respect to coupling plate 313 and foot pad 107) to support proper user foot rest.

Elastic element 307 may be configured to maintain a spatial (e.g. three dimensional) relationship among lever arm 319, torsion arm 317 and gripper structure 331. The spatial relationship may correspond to a specific relative position (e.g. angular or linear) between torsion arm 317 and lever arm 319. For example, elastic element 307 can maintain distal end 333, distal end 329, proximal end 327 and proximal end 335 positioned in a particular spatial relationship. A change of the spatial relationship (e.g. caused by pivoting movements of torsion arm 317, lever arm 319) may cause deformation of elastic element 307 to generate a counter balance torsion force.

In one embodiment, elastic element 307 may include a torsion bar longitudinally arranged along torsion axis 339 between side plates 305. The torsion bar may be made of tendon-like material or other applicable elastic material capable of providing twisting force when deformed. A central passage may be defined longitudinally through the torsion bar substantially along torsion axis 339. In some embodiments, elastic element 307 may comprise pivot rod 325 arranged within the central passage for guiding the deformation of the torsion bar (in elastic element 307).

Elastic element 307 may be shaped to be tightly engaged circumferentially with sleeve element 315 (affixed to torsion arm 317) and cap configuration 309 of gripper structure 331. The deformation of elastic element 307 may be caused by (or based on) a twisting force generated by the torsion bar according to an angular relationship between sleeve element 315 and gripper structure 331 around torsion axis 339. The angular relationship may be determined, for example, by the position of distal end 333 of lever arm 319 relative to torsion arm 317.

Figure 4:
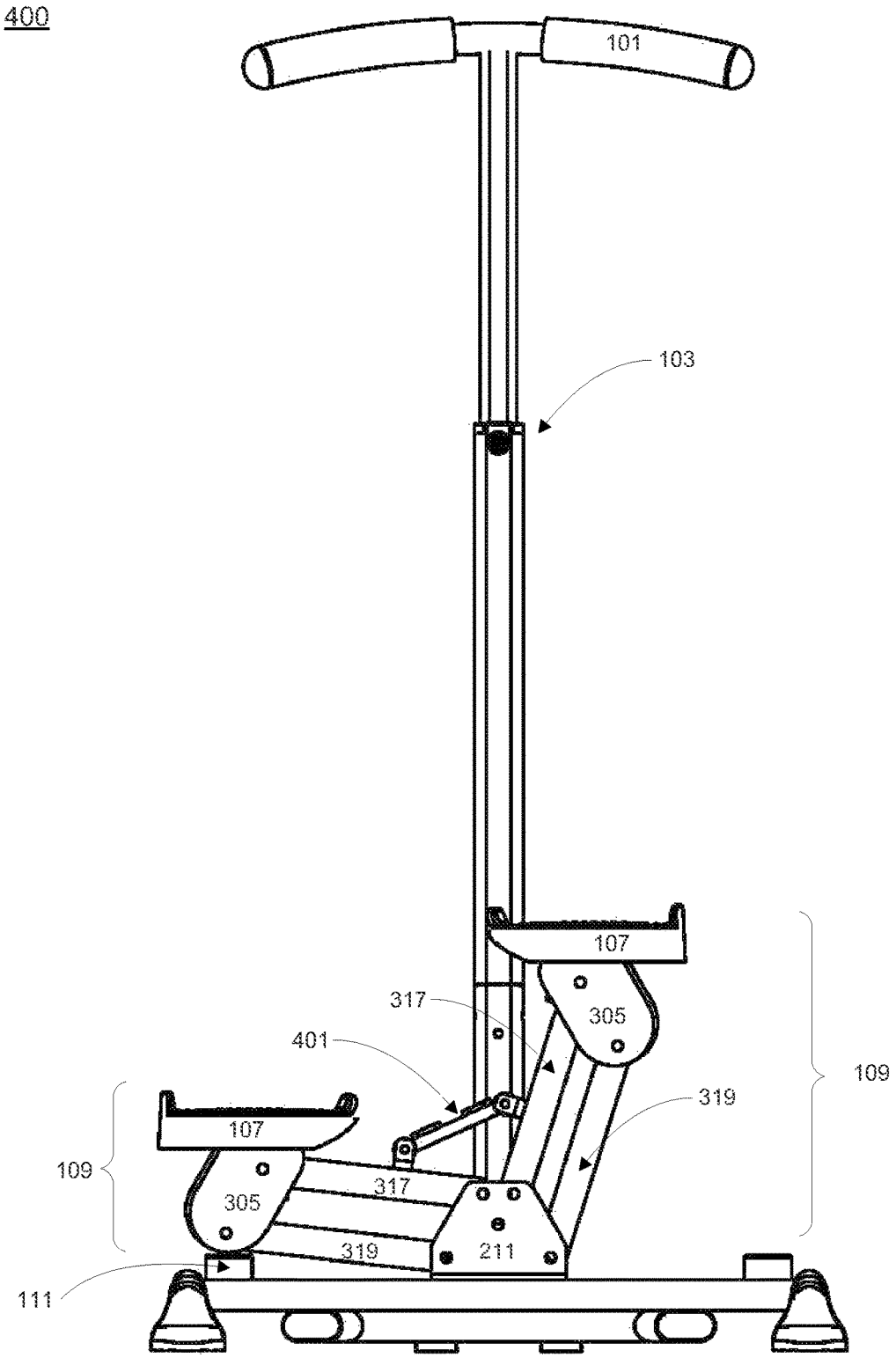
FIG. 4 is a rear view diagram illustrating an embodiment of a torsion based exerciser.

FIG. 4 is a rear view diagram illustrating an embodiment of a torsion based exerciser, such as device 100 of FIG. 1. For example, device 400 may include a pair of resilient pedaling assemblies 109 rotatably connected via a coupling mechanism 401. As the left one of the resilient pedaling assemblies 109 pivots downwardly relative to mounting element 211, the right one of the resilient pedaling assemblies 109 may be pulled upwardly via coupling mechanism 401 and vice versa. Thus, the pair of resilient pedaling assemblies 109 may move in a left-right rocking manner. In one embodiment, coupling mechanism 401 may be rotatably coupled to a corresponding pair of torsion arms 317 of the resilient pedaling assemblies.

Figure 5:
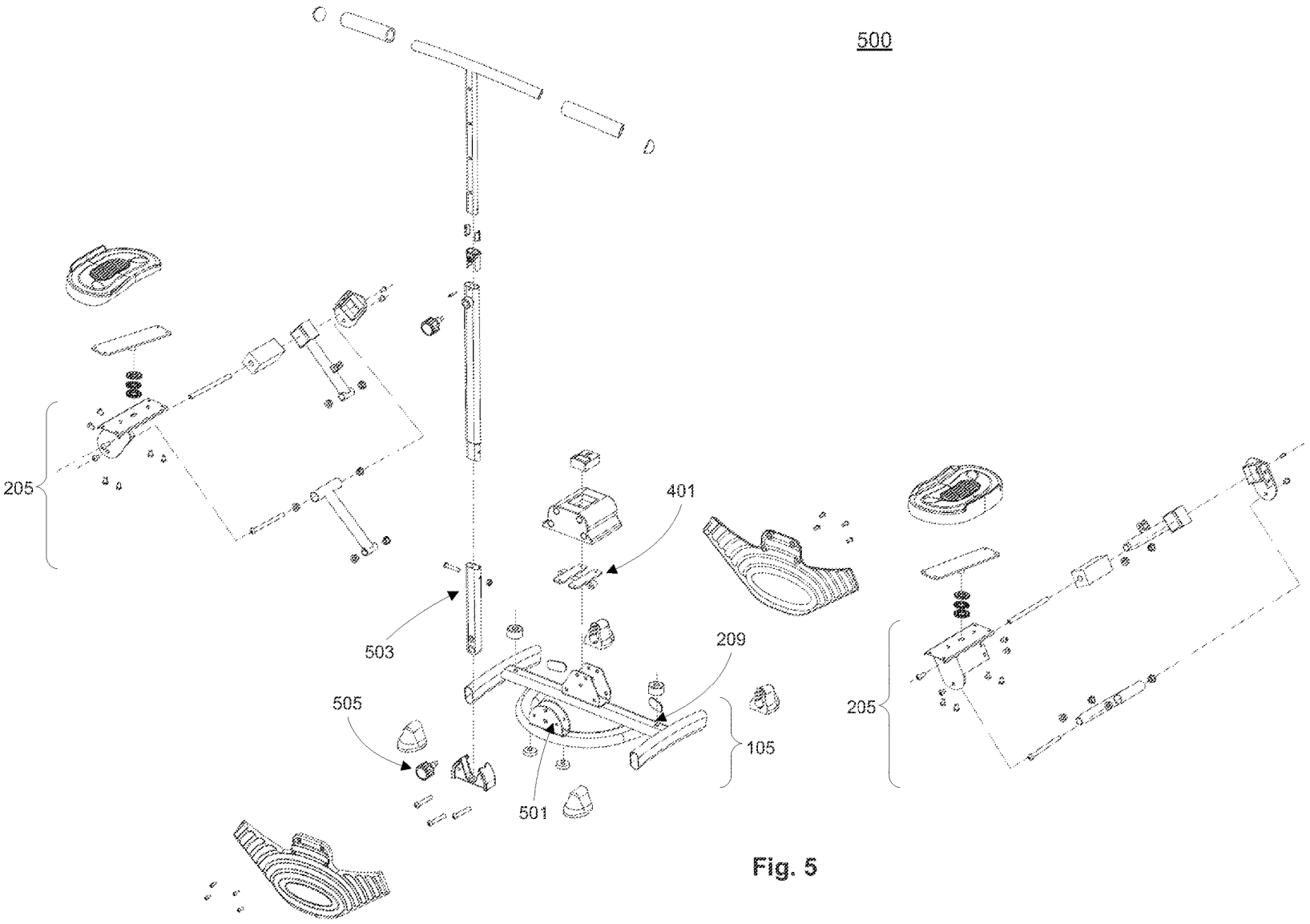
FIG. 5 is a component diagram illustrating an alternative embodiment of a torsion based exerciser.

FIG. 5 is a component diagram illustrating another embodiment of an alternative embodiment of a torsion based exerciser. For example, view 500 may be based on device 100 of FIG. 1 or device 400 of FIG. 4. In one embodiment, lower section 503 of a handle stand may be adjustably affixed to base structure 105 via mounting structure 501. Multiple mounting locations may be defined around mounting structure 501 to allow the handle stand to be affixed to base structure 105 with a varied angular relationship between the handle stand and base structure 105 (e.g. with respect to cross support member 209). In one embodiment, the mounting location between lower section 503 and base structure 105 may be selected via control mechanism 505 (e.g. including a control knob).

Figure 6A:
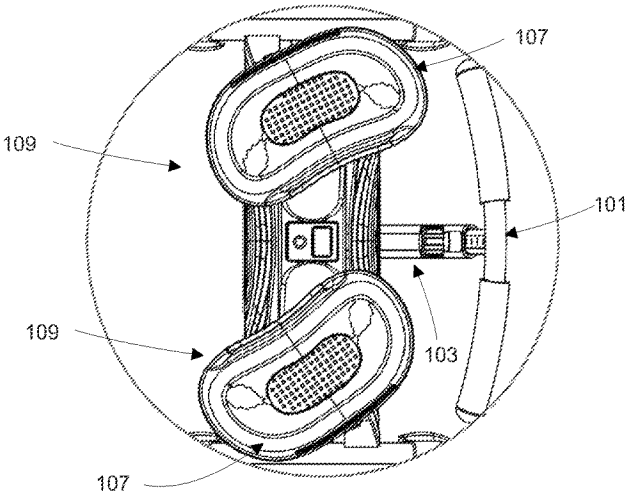
FIGS. 6A-6D illustrate exemplary foot pad configurations of a torsion based exerciser according to one embodiment of the present invention.
Figure 6B:
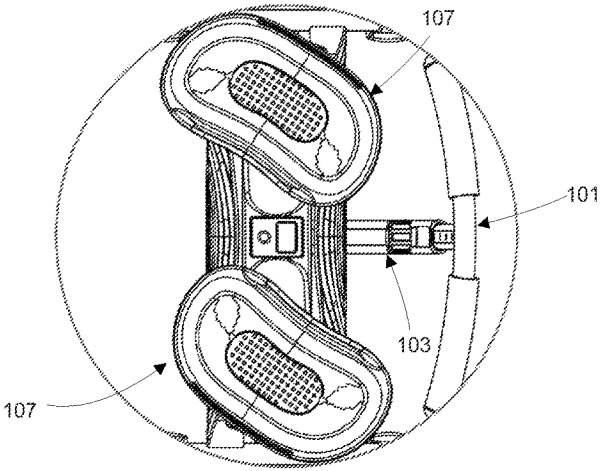

FIGS. 6A-6D illustrate exemplary foot pad configurations of a torsion based exerciser according to one embodiment of the present invention, such as device 100 of FIG. 1. As shown in FIG. 6A, a pair of foot pads 107 may pivot together to the left, for example, relative to a pair of resilient pedaling assemblies 109 to allow a user standing on foot pad 107 holding on handlebar 101 to perform twisting exercises. FIG. 6B may show foot pad 107 pivoting or rotating rightward (e.g. around a substantially vertical axis).

Figure 6C:
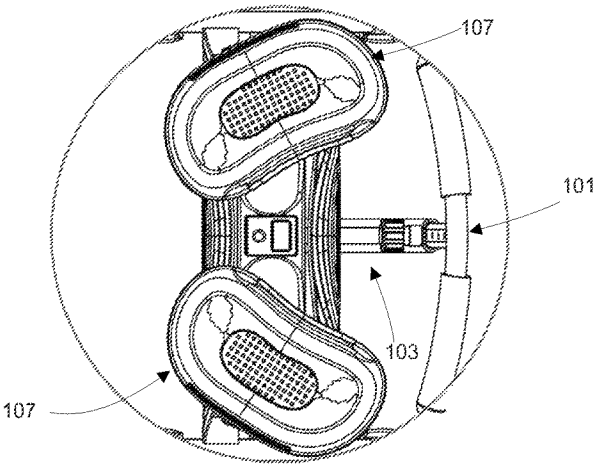
Figure 6D:
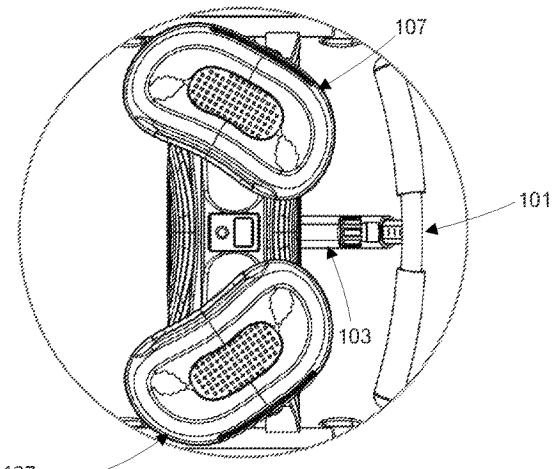
Figure 7A:
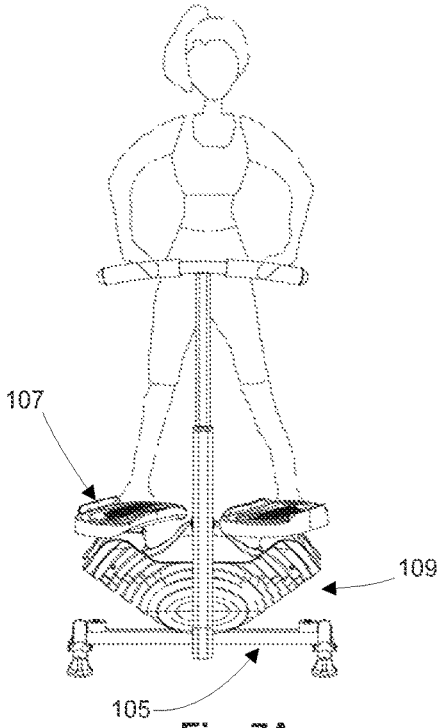
FIGS. 7A-7D show examples of an application of a torsion based exerciser according to one embodiment of the present invention.
Figure 7B:
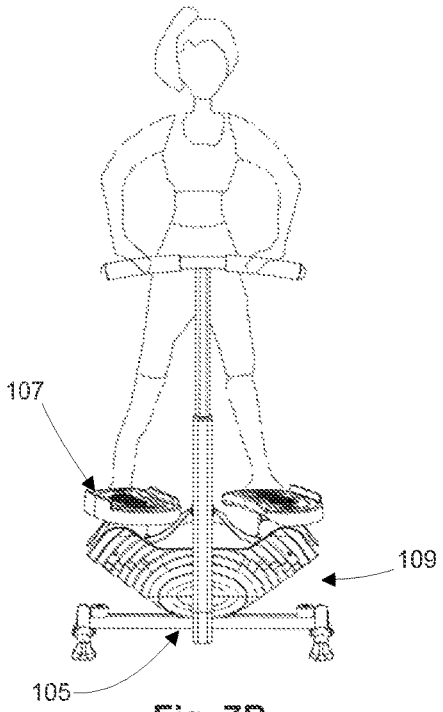
Figure 7C:
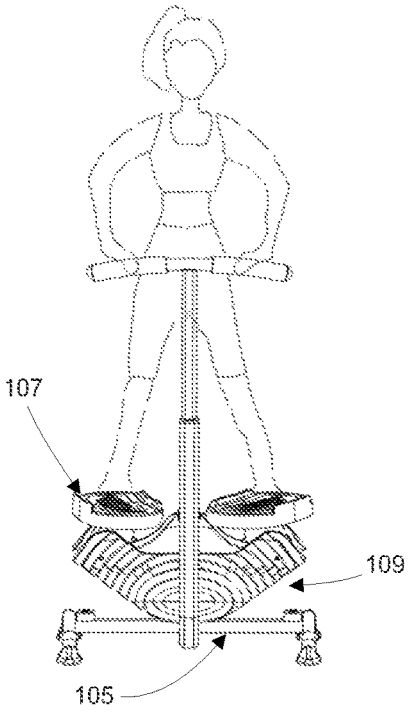
Figure 7D:
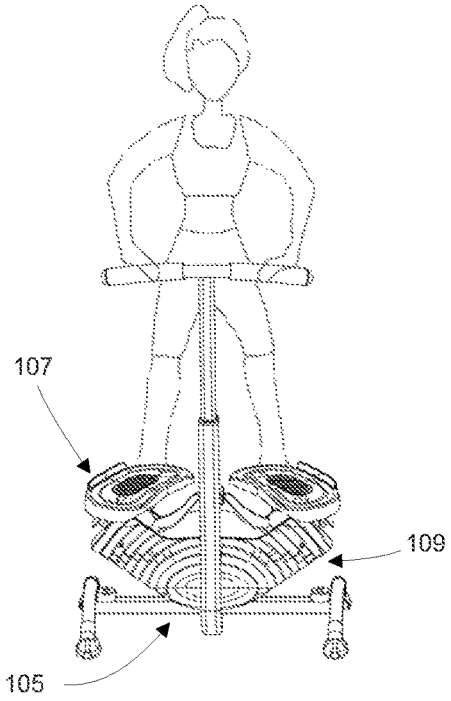

As shown in FIG. 6C, foot pads 107 may pivot outwardly away from each other (e.g. facing towards handlebar 101). Alternatively, as shown in FIG. 6D, foot pads 107 may pivot inwardly towards each other. Resilient pedaling assemblies 109 may remain balance or rock sideways left and right (or right and left) as food pads 107 pivot.

FIGS. 7A-7D show examples of an application of a torsion based exerciser according to one embodiment of the present invention, such as device 100 of FIG. 1. For example, FIGS. 7A, 7B, 7C and 7D may illustrate user exercising turning right, left, inward or outwards via foot pads 107 in manners as discussed above for FIGS. 7A-7D.

Figure 8C:
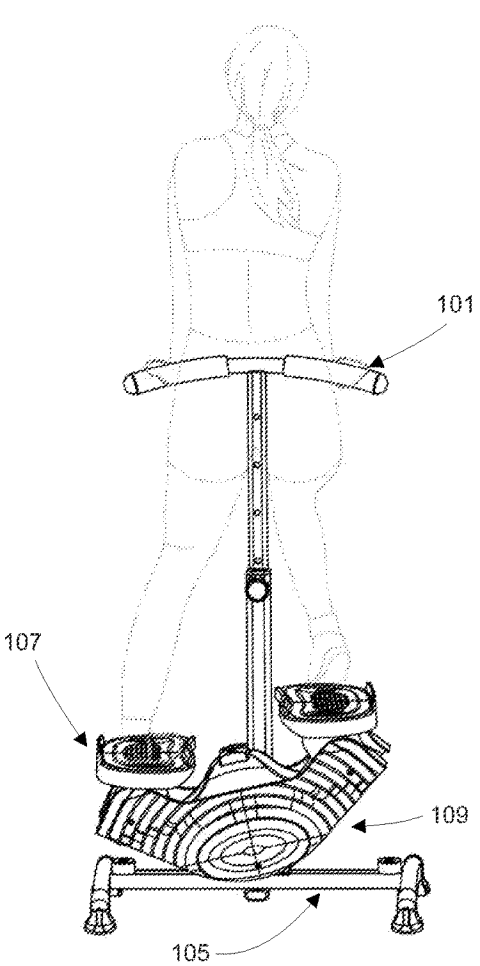
FIGS. 8A-8C show alternative examples of an application of a torsion based exerciser according to one embodiment of the present invention.
Figure 8B:
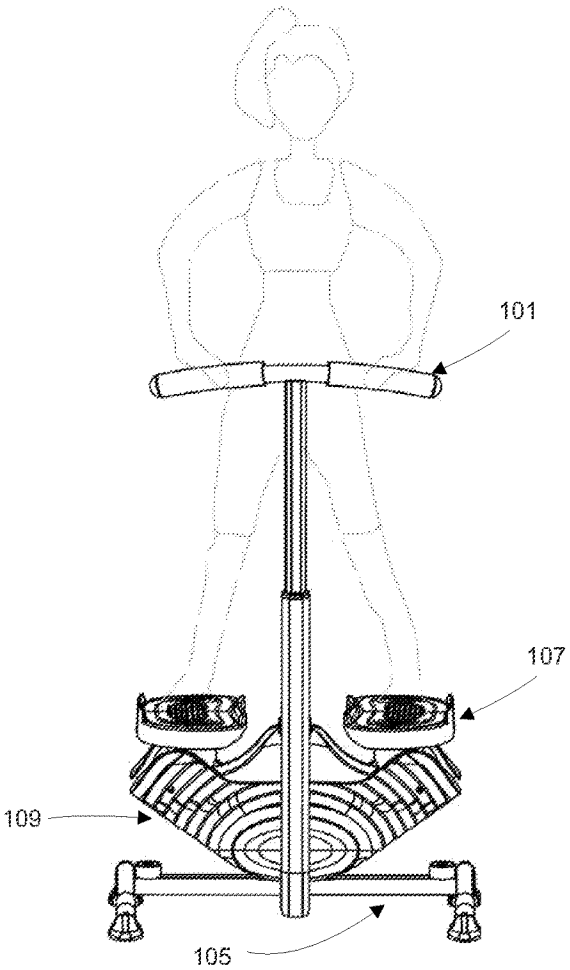
Figure 8A:
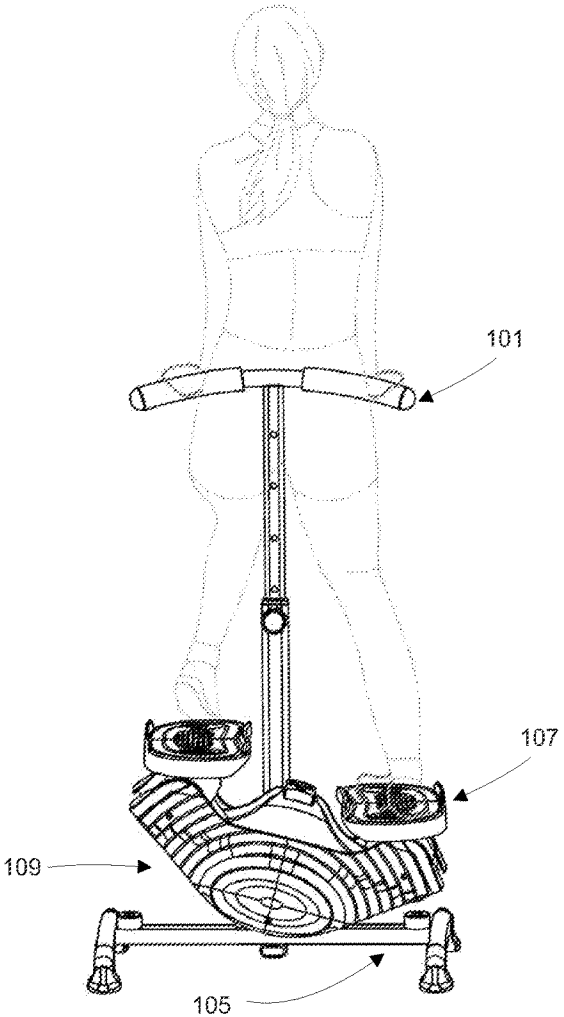

FIGS. 8A-8C show examples of an application of a torsion based exerciser according to one embodiment of the present invention, such as device 100 of FIG. 1. Turning now to FIG. 8A, a pair of resilient pedaling assemblies 109 may rock to one side (e.g. right hand side) via user leg forces exerted while standing on foot pads 107. In some embodiments, the pair of resilient pedaling assemblies 109 may be mutually coupled to move in sync (e.g. via a linking mechanism, such as a connection cover). In FIG. 8B, the user may stand in a neutral position on food pads 107. FIG. 8C shows an example of the pair of resilient pedaling assemblies 109 rocking towards the other side (e.g. left hand side).

Many modifications and other embodiments of the invention set forth herein will come to mind to one skilled in the art to which the invention pertains to having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercise machine comprising:

a support frame having a handle structure affixed to a base structure, the handle structure adapted to provide hand support for a user, the base structure adapted to provide floor support for the machine; and one or a plurality of resilient pedaling assemblies pivotably coupled with the base structure, each resilient pedaling assembly comprising:

an elastic element to provide a torsion force, wherein the elastic element has a longitudinal direction between two ends;

a foot pad, and pivot assemblies rotatably engaged with the elastic element and the foot pad, wherein the pivot assemblies comprise:

an end pivot assembly rotatably engaged with both ends of the elastic element, wherein the foot pad is movably coupled to the end pivot assembly, wherein the end pivot assembly comprises:

a gripper structure fittingly holding the elastic element via the two ends, the gripper structure pivotable around a torsion axis defined substantially aligned with the longitudinal direction of the elastic element, the gripper structure defining a distal lever axis substantially parallel to the torsion axis; and a lever arm having a proximal end and a distal end, wherein the lever arm is pivotally coupled with the gripper structure via the distal end of the lever arm; and a middle pivot assembly rotatably engaged with a portion of the elastic element between the two ends, wherein the middle pivot assembly comprises:

a torsion arm longitudinally having a distal end and a proximal end arranged substantially transverse to the longitudinal direction of the elastic element; and a sleeve element affixed to the distal end of the torsion arm to engage with the elastic element, wherein the portion of the elastic element is fittingly confined through the sleeve element, wherein movement of the foot pad causes deformation of the elastic element via the pivot assemblies, the deformation inducing the torsion force from the elastic element to provide reciprocal foot pedaling effects to the user.

2. The machine of claim 1, wherein the gripper structure comprises:

one or a plurality of side plates, each side plate having a cap configuration to accommodate the elastic element at one of the ends longitudinally, wherein the lever arm is pivotally coupled with the gripper structure via the distal end of the lever arm, and wherein the lever arm is rotatable around the distal lever axis; and a coupling plate affixed between the side plates, wherein the foot pad is rotatably coupled with the coupling plate, wherein the foot pad is rotatable around a rotation axis substantially transverse to the longitudinal direction of the elastic element.

3. The machine of claim 2, wherein the base structure includes a mounting element defining at least a proximal arm axis and a proximal lever axis, the torsion arm is rotatably coupled with the mounting element via the proximal end of the torsion arm, the torsion arm rotatable around the proximal arm axis of the mounting element, wherein the lever arm is pivotally coupled with the mounting element via the proximal end of the lever arm, the lever arm rotatable around the proximal lever axis of the mounting element, and wherein the proximal arm axis, the proximal lever axis and the torsion axis are arranged substantially parallel to each other.

4. The machine of claim 3, wherein the base structure comprises:

one or a plurality of leg members;

a cross support member affixed to the leg members, wherein the mounting element is fixedly attached over the cross support member.

5. The machine of claim 2, wherein the movement of the foot pad is constrained by simultaneous pivoting of the lever arm, the torsion arm and the gripper structure, the lever arm pivoting around the proximal end of the lever arm, the torsion arm pivoting around the proximal end of the torsion arm, the gripper structure pivoting around the lever arm and the torsion arm.

6. The machine of claim 2, wherein the elastic element is configured to maintain a position of the distal end of the lever arm in a particular spatial relationship with respect to the distal end of the torsion arm and the proximal end of the torsion arm, and wherein the deformation of the elastic element corresponds to a change of the position of the distal end of the lever arm from the particular spatial relationship.

7. The machine of claim 6, wherein the elastic element a torsion bar longitudinally arranged along the torsion axis between the side plates, wherein the torsion bar is shaped to be tightly engaged circumferentially with the sleeve element affixed to the torsion arm and the cap configuration of the gripper structure, wherein the deformation of the elastic element is based on a twisting force generated by the torsion bar according to an angular relationship between the sleeve element and the gripper structure around the torsion axis, wherein the angular relationship is determined by the position of the distal end of the lever arm relative to the torsion arm.

8. The machine of claim 7, wherein a central passage is defined longitudinally along the torsion bar substantially along the torsion axis, and wherein the elastic element comprises a pivot rod arranged within the central passage for guiding the deformation of the elastic element.

9. The machine of claim 6, wherein the torsion bar is made of an elastic material capable of providing the twisting force when deformed.

10. An exercise machine comprising:

a support frame having a handle structure affixed to a base structure, the handle structure adapted to provide hand support for a user, the base structure adapted to provide floor support for the machine; and a pair of resilient pedaling assemblies pivotably coupled with the base structure, each resilient pedaling assembly comprising:

an elastic element to provide a torsion force, wherein the elastic element has a longitudinal direction between two ends;

a foot pad; and pivot assemblies rotatably engaged with the elastic element and the foot pad, wherein the pivot assemblies comprise:

an end pivot assembly rotatably engaged with both ends of the elastic element, wherein the foot pad is movably coupled to the end pivot assembly; and a middle pivot assembly rotatably engaged with a portion of the elastic element between the two ends, wherein movement of the foot pad causes deformation of the elastic element via the pivot assemblies, the deformation inducing the torsion force from the elastic element to provide reciprocal foot pedaling effects to the user; wherein the pair of the resilient pedaling assemblies are mutually coupled to constrain movements of the foot pads in a rocking manner between each other.

11. The machine of claim 10, wherein the middle pivot assembly comprises:

a torsion arm longitudinally having a distal end and a proximal end arranged substantially transverse to the longitudinal direction of the elastic element; and a sleeve element affixed to the distal end of the torsion arm to engage with the elastic element, wherein the portion of the elastic element is fittingly confined through the sleeve element.

12. The machine of claim 11, wherein the end pivot assembly comprises:

a gripper structure fittingly holding the elastic element via the two ends, the gripper structure pivotable around a torsion axis defined substantially aligned with the longitudinal direction of the elastic element, the gripper structure defining a distal lever axis substantially parallel to the torsion axis; and a lever arm having a proximal end and a distal end, wherein the lever arm is pivotally coupled with the gripper structure via the distal end of the lever arm.

13. The machine of claim 12, wherein the gripper structure comprises:

one or a plurality of side plates, each side plate having a cap configuration to accommodate the elastic element at one of the ends longitudinally, wherein the lever arm is pivotally coupled with the gripper structure via the distal end of the lever arm, and wherein the lever arm is rotatable around the distal lever axis; and a coupling plate affixed between the side plates, wherein the foot pad is rotatably coupled with the coupling plate, wherein the foot pad is rotatable around a rotation axis substantially transverse to the longitudinal direction of the elastic element.

14. The machine of claim 13, wherein the base structure includes a mounting element defining at least a proximal arm axis and a proximal lever axis, the torsion arm is rotatably coupled with the mounting element via the proximal end of the torsion arm, the torsion arm rotatable around the proximal arm axis of the mounting element, wherein the lever arm is pivotally coupled with the mounting element via the proximal end of the lever arm, the lever arm rotatable around the proximal lever axis of the mounting element, and wherein the proximal arm axis, the proximal lever axis and the torsion axis are arranged substantially parallel to each other.

15. The machine of claim 14, wherein the base structure comprises:

one or a plurality of leg members;

a cross support member affixed to the leg members, wherein the mounting element is fixedly attached over the cross support member.

16. The machine of claim 13, wherein the movement of the foot pad is constrained by simultaneous pivoting of the lever arm, the torsion arm and the gripper structure, the lever arm pivoting around the proximal end of the lever arm, the torsion arm pivoting around the proximal end of the torsion arm, the gripper structure pivoting around the lever arm and the torsion arm.

17. The machine of claim 13, wherein the elastic element is configured to maintain a position of the distal end of the lever arm in a particular spatial relationship with respect to the distal end of the torsion arm and the proximal end of the torsion arm, and wherein the deformation of the elastic element corresponds to a change of the position of the distal end of the lever arm from the particular spatial relationship.

18. The machine of claim 17, wherein the elastic element includes a torsion bar longitudinally arranged along the torsion axis between the side plates, wherein the torsion bar is shaped to be tightly engaged circumferentially with the sleeve element affixed to the torsion arm and the cap configuration of the gripper structure, wherein the deformation of the elastic element is based on a twisting force generated by the torsion bar according to an angular relationship between the sleeve element and the gripper structure around the torsion axis, wherein the angular relationship is determined by the position of the distal end of the lever arm relative to the torsion arm.

19. The machine of claim 18, wherein a central passage is defined longitudinally along the torsion bar substantially along the torsion axis, and wherein the elastic element comprises a pivot rod arranged within the central passage for guiding the deformation of the elastic element.

20. The machine of claim 17, wherein the torsion bar is made of an elastic material capable of providing the twisting force when deformed.

* * * * *